US008288065B2

(12) United States Patent
Sakimura et al.

(10) Patent No.: US 8,288,065 B2
(45) Date of Patent: Oct. 16, 2012

(54) ELECTROPHOTOGRAPHIC PHOTORECEPTOR AND IMAGE FORMATION APPARATUS

(75) Inventors: Tomoo Sakimura, Hino (JP); Takeshi Ishida, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 822 days.

(21) Appl. No.: 12/391,103

(22) Filed: Feb. 23, 2009

(65) Prior Publication Data

US 2009/0214260 A1 Aug. 27, 2009

(30) Foreign Application Priority Data

Feb. 26, 2008 (JP) ..... 2008-044098

(51) Int. Cl.
*G03G 5/06* (2006.01)
*G03G 5/10* (2006.01)

(52) U.S. Cl. ..... 430/59.1; 430/69; 399/159

(58) Field of Classification Search ..... 430/59.1, 430/69; 399/159
See application file for complete search history.

(56) References Cited

U.S. PATENT DOCUMENTS 4,269,919 A * 5/1981 Kuehnle ..... 430/84
5,876,891 A * 3/1999 Takimoto et al. ..... 430/71
7,670,743 B2 * 3/2010 Ohta et al. ..... 399/159
7,764,906 B2 * 7/2010 Niimi ..... 399/159
2002/0025484 A1 * 2/2002 Takeuchi et al. ..... 430/78
2004/0120730 A1 * 6/2004 Niimi et al. ..... 430/59.5
2004/0183885 A1 * 9/2004 Hoshizaki et al. ..... 430/78
2006/0198659 A1 * 9/2006 Niimi ..... 399/159
2007/0154825 A1 * 7/2007 Tamoto et al. ..... 430/78
2009/0011348 A1 * 1/2009 Sakimura et al. ..... 430/69
2009/0280419 A1 * 11/2009 Sakimura et al. ..... 430/59.1
2009/0324281 A1 * 12/2009 Tada et al. ..... 399/159

FOREIGN PATENT DOCUMENTS

JP 2000-47408 A 2/2000

OTHER PUBLICATIONS

Borsenberger, Paul M. et al. Organic Photoreceptors for Imaging Systems. New York: Marcel-Dekker, Inc. (1993), pp. 6-17.*

* cited by examiner

*Primary Examiner* — Christopher Rodee
(74) *Attorney, Agent, or Firm* — Cantor Colburn LLP

(57) ABSTRACT

An objective is to provide an organic photoreceptor exhibiting high sensitivity, suitable for exposure to a semiconductor laser having an emission wavelength of 350-500 nm or a light emitting diode, with which generation of memory images as well as image defects caused by very small charge leakage is inhibited, and also to provide an image forming apparatus fitted with the organic photoreceptor. Also disclosed is an organic photoreceptor possessing a charge generation layer and a charge transport layer provided on a conductive substrate, wherein the charge generation layer contains particles made of a condensed polycyclic pigment, having an average major axis length of 500 nm or less, an average aspect ratio of 2.5-5.0, and an aspect ratio variation coefficient of 16% or less.

4 Claims, 2 Drawing Sheets

ELECTROPHOTOGRAPHIC PHOTORECEPTOR AND IMAGE FORMATION APPARATUS

This application is based on Japanese Patent Application No. 2008-44098 filed on Feb. 26, 2008, the entire content of which is hereby incorporated by reference.

FIELD OF THE INVENTION

The present invention relates to electrophotographic photoreceptors containing a pyranthrone compound used for image formation of an electrophotographic system and an image formation apparatus by use thereof.

BACKGROUND OF THE INVENTION

In recent years, opportunities to use an electrophotographic copier and a printer have been increased in the field of printing as well as color printing. In the field of printing as well as color printing, high quality digital monochromatic or color images tend to be demanded. In order to respond to such the demand, it is proposed that a laser light having a short wavelength is employed as a source for exposure to light to form high definition digital images. However, the electrophotographic image finally obtained has not sufficiently achieved high image quality, even though the laser light having a short wavelength is employed, and the dot size of exposure is narrowed to form a minute electrostatic latent image on the electrophotographic photoreceptor.

The reason is that photosensitive properties of the electrophotographic photoreceptor, an electrification characteristic of toner in a developer and so forth do not satisfy properties required for formation of minute dot latent images as well as formation of toner images.

That is, in cases where the electrophotographic photoreceptor is an organic photoreceptor prepared for a conventional long wavelength laser, (hereinafter, the organic photoreceptor will be also referred to simply as a photoreceptor), reproducibility of dot images is sometimes insufficient since a sensitivity characteristic is insufficient, and no clear dot latent image is formed, when imagewise exposure in which the dot size of exposure is narrowed is conducted with laser light having a short wavelength.

Anthanthrone based pigments and pyranthrone based pigments are conventionally well known as a charge generation material in a photoreceptor utilized for a short wavelength laser (Patent Document 1). However, there is no description in Patent Document 1 concerning polycyclic quinone pigments such as the anthanthrone based pigments subjected to a specific treatment, and they are simply considered to be commercially available pigments, but as for properties such as sensitivity and so forth obtained when these commercially available pigments are employed, neither sensitivity nor high speed performance is sufficiently obtained with a high speed printer and copier equipped with a short wavelength laser which is expected to be developed in the near future.

It is known that a particle size of the charge generation material is minimized to form a charge generation layer having high density of the charge generation material in order to improve sensitivity from another aspect. However, when this particle-minimizing technique is applied to a photoreceptor suitable for a short wavelength laser, sensitivity itself is improved, but sufficient high speed processing or fogging property is not obtained.

A short wave light emission diode (short wave LED) emitting light having wave length of 350-500 nm has characteristics liable not to generate moiré used as a short wave exposure source in comparison with short wave light emission semiconductor laser. However an organic photoreceptor suitable for the short wave LED and utilizing the advantage of the short wave LED has not been developed.

(Patent Document 1) Japanese Patent O.P.I. Publication No. 2000-47408

SUMMARY

The present invention was made on the basis of the above-described problems. It is an object of the present invention to provide an organic photoreceptor exhibiting high sensitivity, suitable for exposure to a light emission diode having an emission wavelength of 350-500 nm, as well as high processing speed of 300 mm/sec or more, with which fog is minimized even under high speed processing. Another object is to provide an image forming apparatus fitted with the organic photoreceptor.

The inventors have found out that when a charge generation material made of particles of a condensed cyclic pigment are arranged to be in the similar forms near an ellipsoid, dispersion characteristics of the pigment in an charge generation layer can be improved, whereby not only sensitivity is improved, but also generation of fog or image defects is minimized even under high speed processing.

The organic photoreceptor comprises a photosensitive layer including a charge generation layer and a charge transport layer provided on an electroconductive substrate.

The organic photoreceptor has a charge generation layer and a charge transport layer provided on a conductive substrate, a ten-point surface roughness Rz of the substrate is from 0.2 μm or less, the charge generation layer contains particles of a condensed polycyclic pigment having an average major axis of 500 nm or less, an average aspect ratio of 2.5 to 5.0, and an aspect ratio variation coefficient of 16% or less, and quantum efficiency Φ of the photoreceptor is not less than 0.5, the quantum efficiency Φ being defined by a Formula of $\Phi=\Delta Q/(n_0 \times e)$, wherein ΔQ is reduced amount of charge [C] in case that light having light amount predetermined so as to make the electric field E becomes ⅔ times of initial electric field after unit time (1 sec.) is exposed to the organic photoreceptor under condition of the initial electric field $E_0=2.5\times10^5$ [$V\cdot cm^{-1}$], and $n_0$ ([$cm^{-2}\cdot s^{-1}$]) is a number of incident photons per unit area (1 $cm^2$) and in unit time (1 sec.) in case that light having light amount predetermined so as to make the electric field E becomes ⅔ times of initial electric field after unit time (1 sec.) is exposed to the organic photoreceptor under condition of the initial electric field $E_0=2.5\times10^5$ [$V\cdot cm^{-1}$], and e is an amount of charge that an electron has, or an elementary electric charge, $1.3\times10^{-19}$ [C].

The condensed polycyclic pigment is preferably a compound represented by the Formula (1).

Formula (1)

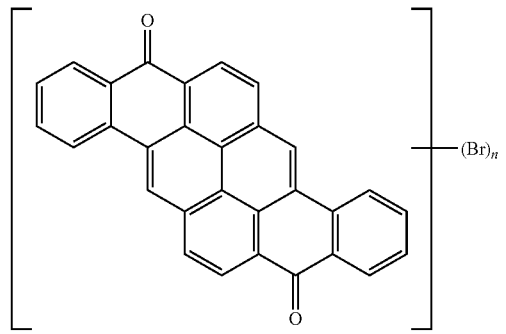

In the formula n is an integer of 1 to 6.

The condensed polycyclic pigment is a charge generation material in the organic photoreceptor.

The organic photoreceptor is suitably employed in an image forming apparatus, which includes a charging device to charge the organic photoreceptor, a light exposing device which exposes the charged organic photoreceptor to form an electrostatic latent image, a developing device to develop the latent image by a toner for forming a toner image and a transfer device which transfers the developed toner image to a transferee, and the exposing device comprises an emission diode having an emission peak at wavelength of 350 to 500 nm as the imagewise exposure source.

The organic photoreceptor of this invention is suitable for image exposure employing short wave LED for the image forming, and generation of image noise such as black spots or fogging is minimized and gives an electrostatic photographic image with good gradation characteristics of a halftone image.

DESCRIPTION OF THE PREFERRED EMBODIMENTS

Figure 1:
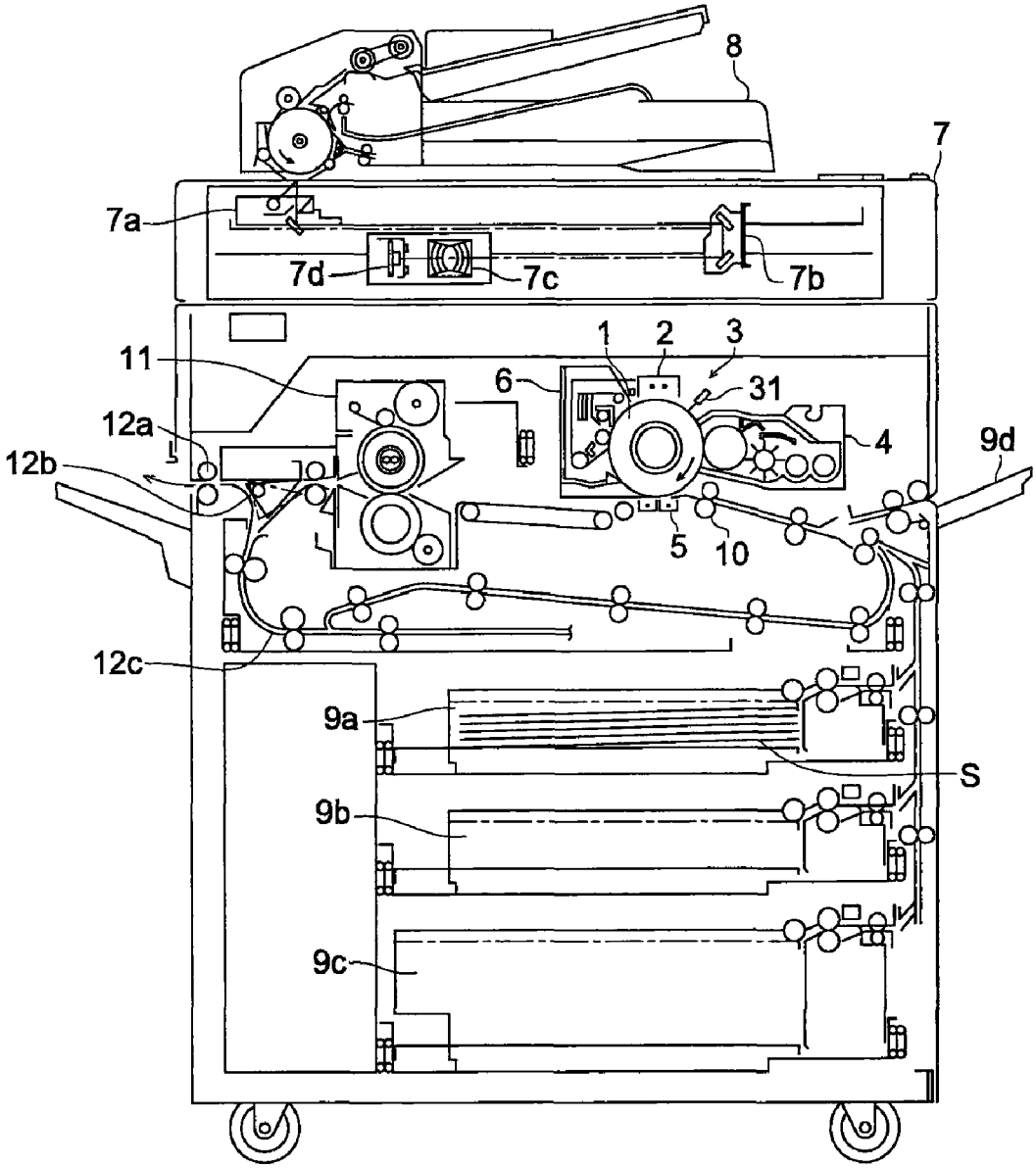
FIG. 1 is a schematic diagram of an image forming apparatus of the present invention fitted with functions therein.

The organic photoreceptor of this invention comprises a photosensitive layer including a charge generation and a charge transport layer provided on a conductive substrate. The substrate has a ten-point surface roughness Rz of the substrate of 0.2 μm or less. The charge generation layer comprises particles of a condensed polycyclic pigment, having an average major axis length of 500 nm or less, an average aspect ratio of 2.5 to 5.0, and an aspect ratio variation coefficient of 16% or less. And quantum efficiency Φ of the photoreceptor is not less than 0.5.

The average major axis length of the pigment particles is preferably not less than 50 nm, more preferably 100 to 450 nm and particularly preferably 200 to 400 nm.

The average aspect ratio of the pigment particles is preferably 2.8 to 4.8, more preferably 3.0 to 4.5.

The aspect ratio variation coefficient is preferably 6 to 16%, and more preferably 8 to 15%.

Definition of a major axis length, a minor axis length and an aspect ratio of the particle of the condensed polycyclic pigment will be described.

Figure 3:
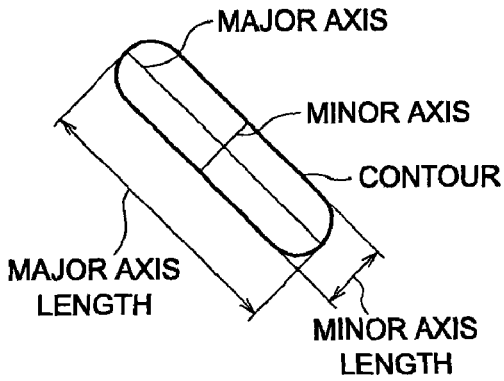
FIG. 3 is a schematic view of photographic image of the particle projected on a plain.

The major axis length and the minor axis length of a particle of a pigment particle are determined from a contour of the particle of a photographic image via photographing of the particle projected on a plain. FIG. 3 illustrates a schematic view of photographic image of the particle projected on a plain. First, when the above-described contour is sandwiched between two parallel lines tangent to the contour, two parallel lines by which the spacing between the two lines is maximized is determined, and a segment made from a straight line, by which two contact points bringing these two parallel lines into contact with the contour of the particle are connected, is called a major axis. The length of this segment is defined as "major axis length". A segment made from a straight line passing through the center of the resulting major axis length and being drawn on the same plane as that of the contour, by which two points at which a perpendicular line intersects with the contour of the particle are connected, is called a minor axis, and the length of this segment is defined as "minor axis length".

In order to measure the major and minor axes of a particle of the polycyclic pigment, an enlarged micrograph of the pigment particle was photographed at a magnification of 2000 times employing a scanning electron microscope (manufactured by JEOL Ltd.), and conducted was an analysis of the photographic image scanned by a scanner employing an automatic image processing analyzer (Luzex AP, manufactured by Nireco Corporation) fitted with software version Ver. 1.32. In this case, the major axis length and the minor axis length of each of 1,000 pigment particles were measured, and an average major axis length, an average aspect ratio and an aspect ratio variation coefficient are calculated.

Average Major Axis Length

The average major axis and the average minor axis are an average of the major axes and the minor axes of 1,000 pigment particles, respectively.

Average Aspect Ratio

The aspect ratio is a ratio of (major axis length/minor axis length) of a pigment particle.

The average aspect ratio is an average value of the aspect ratios of 1,000 pigment particles.

Aspect Ratio Variation Coefficient

The aspect ratio variation coefficient is calculated by the following formula.

$$\text{Aspect ratio variation coefficient}=[S/K]\times 100[\%]$$

In the formula, S represents a standard deviation of aspect ratios of 1,000 pigment particles, and K represents an average value of aspect ratios of said 1,000 pigment particles.

The condensed polycyclic pigment includes a polycyclic quinone pigment, a perylene pigment or the like. A compound represented by foregoing Formula (1) is preferable among them.

The compound represented by foregoing Formula (1) will be described.

In the compound represented by Formula (1), the number n of substituent Br is 1 to 6, and substitution positions of the bromine atom may be at the positions of $R_1$ through $R_{14}$ in the following Formula (2). In the formula, $R_1$ through $R_{14}$ is a bromine atom or a hydrogen atom wherein a number of bromine atoms is 1 to 6.

Formula (2)

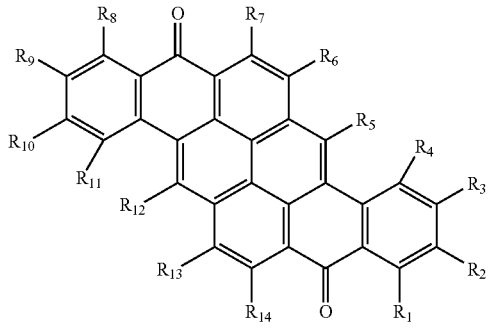

However, the substitution position can not be precisely identified, since the means to precisely identify the substitution position of Br is not established.

The compound represented by Formula (1) is obtained as an admixture with the number of substitution Br represented by n being a plural number as described in the following synthetic examples, and the admixture is preferably utilized as charge generation material (CGM) in a charge generation layer.

Examples of synthesis of the compound represented by the Formula (1) will be described.

Synthesis Example 1

CGM-1 (Mixture of n=1 to 3)

First, 5.0 g by mass of 8,16-pyranthrenedione and 0.25 g of iodine were dissolved in 50 g of chlorosulfuric acid and further thereto, 3.0 g of bromine are dropwise added. After completing addition, the reaction mixture was heated to 50° C. and stirred for 3 hours with heating to undergo reaction. After completion of the reaction, the reaction mixture was cooled to room temperature and poured into 500 g of ice. After filtering and washing, drying was performed to obtain 6.8 g of pigment raw material.

Into a glass tube made of PYREX (trade name) was placed 5.0 g of the obtained pigment raw material. The glass tube was disposed in a furnace structured to provide a temperature gradient of ca. 440° C. to ca. 20° C. along the tube (capable of having a temperature gradient of ca. 440° C. to ca. 20° C. per 1 m). While the interior of the glass tube being evacuated to $1\times10^{-2}$ Pa, the position at which the glass tube containing a pyranthrone compound to be purified was disposed was heated to approximately 440° C. The thus formed vapor was moved to the lower temperature side to allow condensation. There was recovered 2.4 g of sublimated compound (CGM-1) condensed in the region of approximately 300-380° C.

The resulted compound was determined as a mixture of n of 1 to 3 and peak intensity ratio n=1/n=2/n=3 of 11/59/30 by mass spectrum measurement of CGM-1.

Synthesis Example 2

CGM-2 (Mixture of n=3 to 5)

Dissolved were 5.0 g of 8,16-pyranthrenedione and 0.25 g of iodine in 50 g of chlorosulfuric acid and further thereto, 5.9 g of bromine were dropwise added. After completing addition, the reaction mixture was heated to 70° C. and stirred for 5 hours with heating to undergo reaction. After completion of the reaction, the reaction mixture was cooled to room temperature and poured into 500 g of ice. After filtering and washing, drying was performed to obtain 8.5 g of pigment raw material.

Into a glass tube made of PYREX (trade name) was placed 5.0 g of the obtained pigment raw material. The glass tube was disposed in a furnace structured to provide a temperature gradient of ca. 460° C. to ca. 20° C. along the tube (capable of having a temperature gradient of ca. 460° C. to ca. 20° C. per 1 m). While the interior of the glass tube being evacuated to $1\times10^{-2}$ Pa, the position at which the glass tube containing a pyranthrone compound to be purified was disposed was heated to approximately 460° C. The thus formed vapor was moved to the lower temperature side to allow condensation. There was recovered 3.3 g of sublimated compound (CGM-2) condensed in the region of approximately 300-400° C.

The resulted compound was determined as a mixture of n of 3 to 5 and peak intensity ratio n=3/n−4/n=5 of 16/67/17 by mass spectrum measurement of CGM-2.

Synthesis Example 3

CGM-3 (Mixture of n=3 to 6)

Dissolved were 5.0 g of 8,16-pyranthrenedione and 0.25 g of iodine in 50 g of chlorosulfuric acid and further thereto, 5.9 g of bromine were dropwise added. After completing addition, the reaction mixture was heated to 75° C. and stirred for 6 hours with heating to undergo reaction. After completion of the reaction, the reaction mixture was cooled to room temperature and poured into 500 g of ice. After filtering and washing, drying was performed to obtain 8.7 g of pigment raw material.

Into a glass tube made of PYREX (trade name) was placed 5.0 g of the obtained pigment raw material. The glass tube was disposed in a furnace structured to provide a temperature gradient of ca. 480° C. to ca. 20° C. along the tube (capable of having a temperature gradient of ca. 480° C. to ca. 20° C. per 1 m). While the interior of the glass tube being evacuated to $1\times10^{-2}$ Pa, the position at which the glass tube containing a pyranthrone compound to be purified was disposed was heated to approximately 480° C. The thus formed vapor was moved to the lower temperature side to allow condensation. There was recovered 3.0 g of sublimated compound (CGM-3) condensed in the region of approximately 300-420° C.

The resulted compound was determined as a mixture of n of 3 to 6 and peak intensity ratio n=3/n=4/n=5/n=6 of 17/51/27/5 by mass spectrum measurement of CGM-3.

Adjusting Aspect Ratio

A multi-step dispersion employing dispersing beads having high specific gravity is preferable in order to adjust an average aspect ratio and an aspect ratio variation coefficient, and to fall them within the specified range. The multi-step dispersion is a dispersing method by which dispersing is conducted in combination with multiple dispersing steps with the different dispersion condition. Usable examples of homogenizers to conduct the multi-step dispersion include a sand mill, ball mill, an ultrasonic homogenizer and so forth. Multi-step dispersion employing zirconia beads having a small particle diameter are preferable.

The multi-step dispersion comprises a plurality of dispersion steps in which dispersion condition is different from each other. The dispersion condition includes a dispersion method, dispersion time, volume ratio of solvent to the pigment, kinds and diameter of dispersion medium, amount of a polymer vehicle if employed, and so on. As the multi-step dispersion, conducted are dispersions in such a way that the first dispersion is conducted with no polymer vehicle, the second dispersion is conducted under a different dispersion condition from that of the first dispersion, and subsequently, the third dispersion is additionally conducted with the other condition. The dispersion condition can be varied by selecting the particle size and material of the beads, disk peripheral speed, processing temperature and time, employing a polymer vehicle, content of solvent or polymer vehicle and so on.

As a dispersion composition, the solid content of a pigment is preferably 5-15% by volume, based on a dispersion medium (solvent and a polymer vehicle if any).

Binder resins used for preparation of the charge generation layer are also used as the polymer vehicle in the multi-step dispersion process.

The quantum efficiency will be described.

The quantum efficiency is defined by the following formula.

$$\Phi=\Delta Q/(n_0\times e)$$

In the formula, ΔQ is reduced amount of charge [C] in case that light having light amount predetermined so as to make the electric field E becomes ⅔ times of initial electric field after unit time (1 sec.) is exposed to the organic photoreceptor under condition of the initial electric field $E_0=2.5\times10^5$ [$V\cdot cm^{-1}$], and $n_0$ is a number of incident photons [$cm^{-2}\cdot s^{-1}$], per unit area (1 $cm^2$) and in unit time (1 sec.), in case that light having light amount predetermined so as to make the electric field E becomes ⅔ times of initial electric field after unit time (1 sec.) is exposed to the organic photoreceptor under condition of the initial electric field $E_0=2.5\times10^5$ [$V\cdot cm^{-1}$], and e is an amount of charge that an electron has, or an elementary electric charge, $1.3\times10^{-19}$ [C].

The number of incident photons $n_0$ [$cm^{-2}\cdot s^{-1}$], per unit area (1 $cm^2$) and in unit time (1 sec.) is obtained by the following method.

Amount of light of irradiation to the surface of the organic photoreceptor per unit area (1 $cm^2$) is measured by LIGHT PPOWER METER Q8230, with a sensor Q82324A, manufactured by Advantest Corp.

Energy per one photon $E_\lambda$ is obtained by the following formula employing wavelength of incident light λ.

$$E_\lambda=hc/\lambda$$

In the formula, h is Planck's constant ($6.63\times10^{-34}$ [J·s]), and c is velocity of light. The wave length λ is emission peak wave length. LED having emission peak wavelength of 405 nm is employed in Examples described later.

The number of incident photons $n_0$ [$cm^{-2}\cdot s^{-1}$], per unit area (1 $cm^2$) and in unit time (1 sec.), is obtained by the formula of $$n_0=W_0/E_\lambda[cm^{-2}\cdot s^{-1}].$$

ΔQ is obtained by the formula $$\Delta Q=\Delta V\times C.$$

In the formula, ΔV is an absolute value of difference of surface potential V in case that light having light amount predetermined so as to make the electric field E becomes ⅔ times of initial electric field after unit time (1 sec.) is exposed to the organic photoreceptor, and static electric charge of the photoreceptor per unit area (1 $cm^2$) is C, under condition of the initial electric field $E_0=2.5\times10^5$ [$V\cdot cm^{-1}$]

The static electric charge is measured in the following manner.

The organic photoreceptor excluding a substrate is cut out in size of 2 cm×2 cm, electrodes are prepared on a surface of the obtained piece by gold sputtering. The static electric charge of the samples is measured by an LCR meter (impedance analyzer 4192A, manufactured by Yokogawa Hewlett-Packard Ltd.). The static electric charge per unit area of the organic photoreceptor is obtained by dividing the measured value of the piece by its area.

It is important that the charge generation layer of the organic photoreceptor of this invention contains particles of a condensed polycyclic pigment having an average major axis of 500 nm or less, an average aspect ratio of 2.5 to 5.0, and an aspect ratio variation coefficient of 16% or less, and further quantum efficiency Φ of the photoreceptor is not less than 0.5. The quantum efficiency can be controlled by selecting the average major axis, the average aspect ratio and aspect ratio variation coefficient of the pigment particles, kinds of charge transfer material, binder resin of the charge transfer layer and the thickness of the charge transfer layer, structure of the intermediate layer such as binding polymer, filler particles and the thickness, and so on, in combination.

The charge generation function and the charge transfer function are essential functions for constituting the electrophotographic photoreceptor. The organic electrophotographic photoreceptor contains an organic compound having at least one of the charge generation function and the charge transfer function. The organic photoreceptor includes organic photoreceptors such as those constituted by organic charge generation materials or organic charge transfer materials and those containing a polymer complex having the charge generation function and the charge transfer function.

The organic photoreceptor includes the following constitutions;

1) A charge generation layer and a charge transfer layer are successively provided as the photosensitive layer on an electroconductive substrate, 2) A charge generation layer, a first charge transfer layer and a second charge transfer layer are successively provided as the photosensitive layer on an electroconductive substrate, 3) A surface protective layer is provided on the photosensitive layer of each of the photoreceptors 1) or 2).

The photoreceptor having any of the above constitutions are applicable. A under coat layer (intermediate layer) may be provided on the electroconductive substrate in previous to the formation of the photosensitive layer even when the photoreceptor has any constitution.

The charge transfer layer is a layer having a function to transfer the charge carrier generated in the charge generation layer by light exposure to the surface of the organic photosensitive layer, and the charge transfer function can be confirmed by detecting photoconductivity of the sample formed by superposing the charge generation layer and the charge transfer layer on the electroconductive substrate.

The constitution of the organic photoreceptor is described below principally referring the constitution 1).

Electroconductive Substrate

Both of sheet-shaped and cylinder-shaped electroconductive substrates are applicable for the photoreceptor, and the cylindrical one is preferable for making compact the image forming apparatus.

The cylindrical electroconductive substrate is a cylindrical substrate necessary for endlessly forming images by rotation thereof, and one having a straightness of not more than 0.1 mm and a shaking of not more than 0.1 mm is preferable.

A drum of metal such as aluminum and nickel, a plastic drum on which an electroconductive material such as aluminum, tin oxide and indium oxide is vapor deposited and a paper-plastic drum on which an electroconductive material is coated are usable as the electroconductive material. The relative resistivity of the electroconductive substrate is preferably not more than $10^3$ Ωcm at room temperature. The aluminum substrate is most preferable for the electroconductive substrate of the photoreceptor of the invention. One containing another ingredient such as manganese, zinc and magnesium additionally to aluminum may be used as the aluminum substrate.

Macroscopically, a photoreceptor of the invention is preferably has a ten-point surface roughness Rz of from 0.2 μm or less. A thin charge generation layer is not disturbed by an unevenness of the roughness of the surface of the substrate by employing the substrate with mirror finished surface having Rz of from 0.2 μm or less, and charge a generation material is maintained uniform dispersion state in the charge generation layer, whereby minute latent image can be formed via short wave LED exposure.

The surface having Rz of from 0.02 μm or less can be obtained by mirror finish process such as cutting operation. A definition and a measurement method of ten-point surface roughness Rz Rz is defined as described in JISB 0601-1982 including a standard length and measure length, that is, a difference between a mean height of the highest 5 peaks and a mean depth of the lowest 5 bottoms.

In the example described below, ten-point surface roughness Rz is measured by a surface roughness meter (SURFCORDER SE-30H, produced by Kosaka Laboratory Ltd.).

Measure condition by SE-30H is as follows.

Measure distance: Five times of reference length

Number of measure point: Three points including both sides and center, wherein both sides are 5 cm inner from the ends.

Measure magnitude: Longitude, 5,000 times, latitude, 20 times.

Intermediate Layer

The electrophotographic photoreceptor relating to the invention may be provided with an intermediate layer between a conductive substrate and a photosensitive layer.

Such an intermediate layer preferably contains N-type semiconductor particles. The N-type semiconductor particles refer to particles exhibiting the property of the main charge carrier being electrons. In other words, since the main charge carrier is electrons, the intermediate layer using N-type semiconductor particles exhibits properties of efficiently blocking hole-injection from the substrate and reduced blocking for electrons from the photosensitive layer.

Preferred N-type semiconductor particles include titanium oxide ($TiO_2$) and zinc oxide (ZnO), of which the titanium oxide is specifically preferred.

N-type semiconductor particles employ those having a number average primary particle size of 3 to 200 nm, and preferably 5 to 100 nm. The number average primary particle size is a Fere-direction average diameter obtained in image analysis when N-type semiconductor particles are observed by a transmission electron microscope and 1,000 particles are randomly observed as primary particles from images magnified at a factor of 10,000. In cases when the number average primary particle size of N-type semiconductor particles is less than 3 nm, it becomes difficult to disperse the N-type semiconductor particles in a binder constituting an intermediate layer and the particles are easily aggregated, so that the aggregated particles act as a charge trap, making it easy to cause a transfer memory.

When the number average primary particle size is more than 200 nm, N-type semiconductor particles cause unevenness on the intermediate layer surface, tendering to cause non-uniformity of images via such unevenness. Further, when the number average primary particle size is less than 200 nm, N-type semiconductor particles easily coagulate in the dispersion, often causing dot image deterioration.

Crystal forms of titanium oxide particles include an anatase type, rutile type, brucite type and the like. Of these, rutile type or anatase type titanium oxide particles effectively enhance rectification of a charge passing the intermediate layer. They are most preferable N-type semi-conductive particles used in this invention as mobility of electrons is enhanced to stabilize the charging potential, and increase of residual potential is inhibited, contributing to inhibition of deterioration of dot image.

The N-type semiconductor particle treated on the surface by a polymer containing methylhydrogen siloxane unit is preferable. The polymer containing methylhydrogen siloxane unit having a molecular weight of from 1,000 to 20,000 displays high surface treatment effect. Therefore, the rectification ability of the N-type semiconductor particle is raised, so that occurrence of black spots can be inhibited and sufficient reproducibility of dot image can be obtained by the use of the intermediate layer containing such the N-type semiconductor particles.

The polymer containing methylhydrogen siloxane unit is preferably a copolymer of a structural unit of —(HSi($CH_3$)O)— and another structural unit namely another siloxane unit. As the other siloxane unit, a dimethylsiloxane unit, a methylethylsiloxane unit, a methylphenylsiloxane unit, and a diethylsiloxane unit are preferable and dimethylsiloxane is particularly preferable. The ratio of the methylhydrogen siloxane unit in the copolymer is from 10 to 99 mole-percent and preferably from 20 to 90 mole-percent.

The methylhydrogen siloxane copolymer may be any of a random copolymer, a block copolymer and a graft copolymer, and the random copolymer and the block copolymer are preferable. The copolymer ingredient other than the methylhydrogen siloxane may be one, two or more.

The intermediate layer coating liquid prepared for forming the intermediate layer comprises a binder resin and a dispersing solvent additionally to the N-type semiconductor particles such as the surface treated titanium oxide.

The ratio of the N-type semiconductor particles in the intermediate layer is preferably from 1.0 to 2.0 times of the volume of the binder resin in the intermediate layer. The rectification ability of the intermediate layer is raised by the use of the N-type semiconductor particle in the intermediate layer in such the high concentration so that the raising in the residual potential and the degradation of the dot image can be effectively prevented even when the thickness of the intermediate layer is made thick and suitable organic photoreceptor can be prepared. N-type semi-conductive particles in an amount of 100 to 200 volume parts are preferably used for 100 volume parts of binder resin in the intermediate layer.

Polyamide resin is preferably used for sufficiently dispersing the particles as the binder resin for dispersing the particles to form the intermediate layer, and the following polyamide resins are particularly preferred.

An alcohol-soluble polyamide resin is preferable for the binder resin of the intermediate layer. As the binder resin of the intermediate layer of the organic photoreceptor, a resin having high solubility in solvent is required for forming the intermediate layer having uniform thickness. A copolymerized polyamide resin having a chemical structure which has few carbon chains between the amide bonds such as 6-Nylon is used as the alcohol-soluble polyamide resin. Moreover, the following polyamides can be preferably used other than the above resin.

N-1

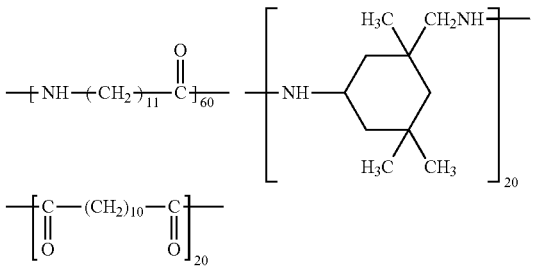

-continued

N-2

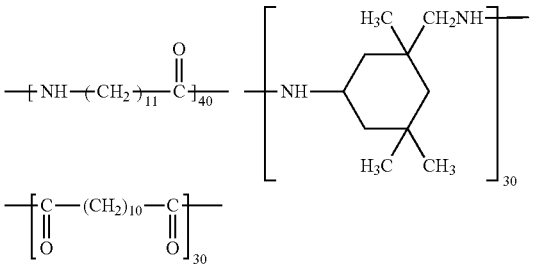

N-3

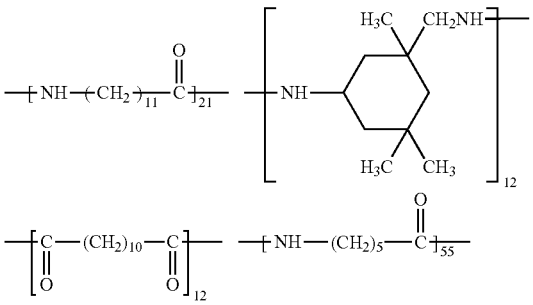

N-4

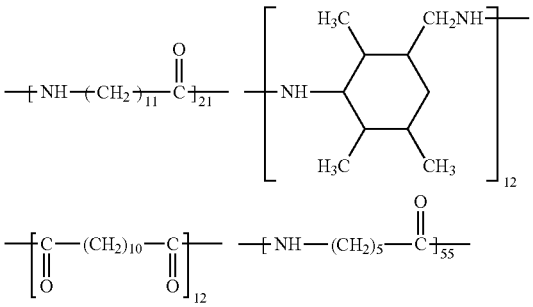

N-5

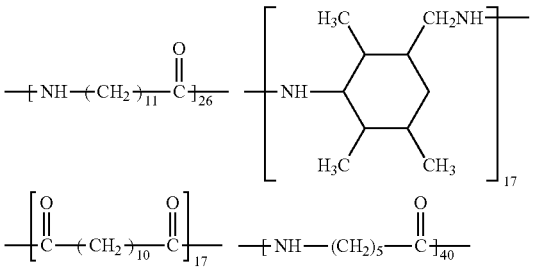

Content ratio of the polyamide N-1 to N-5 is described in terms of molar % respectively.

The number average molecular weight of the polyamide resin is preferably from 5,000 to 80,000, and more preferably from 10,000 to 60,000. A uniform thickness of the intermediate layer is obtained so that the effect of the invention is displayed by employing the number average molecular weight of the polyamide resin from 5,000 to 80,000.

A part of the polyamide resin listed above is marketed, for example, under the trade name of VESTAMELT X1010 and X4685, manufactured by Daicel-Degussa Ltd. They can be produced by common synthesizing method of polyamide.

An alcohol having 2 to 4 carbon atoms such as ethanol, n-propyl alcohol, iso-propyl alcohol, n-butanol, t-butanol and sec-butanol is preferable solvent for dissolving the polyamide resin to prepare the coating liquid, which is superior in the dissolving ability to the polyamide and the coating suitability of the coating liquid. The ratio of such the solvent in the whole solvent is from 30 to 100%, preferably from 40 to 100%, and more preferably from 50 to 100%, by weight. Methanol, benzyl alcohol, toluene, methylene chloride, cyclohexanone and tetrahydrofuran are usable as a co-solvent giving good result by using together with the above solvent.

The thickness of the intermediate layer is preferably from 0.3 to 10 μm. Generation of black spots is minimized and good reproduction of dot image is obtained by a thickness of intermediate layer of from 0.3 to 10 μm. The thickness of intermediate layer is more preferably from 0.5 to 5 μm.

It is preferable that the intermediate layer is substantially electric insulating. The insulating layer has a layer having a volume resistance of not less than $1\times10^{8}$ Ω·cm. The volume resistance of the intermediate layer and the protective layer is preferably from $1\times10^{8}$ to $1\times10^{15}$ Ω·cm, more preferably from $1\times10^{9}$ to $1\times10^{14}$ Ω·cm, and further preferably from $2\times10^{9}$ to $1\times10^{13}$ Ω·cm. The volume resistance can be measured by the following method.

Measuring condition: According to JIS C2318-1975

Measuring apparatus: HIRESTA IP manufactured by Mitsubishi Chemical Corporation.

Measuring probe: HRS

Applying voltage: 500 V

Environmental condition: 30±2° C., 80±5 RH %

When the volume resistance is not less than $1\times10^{8}$ Ω·cm, good blocking ability of the intermediate layer is obtained, occurrence of black spots is minimized and good potential holding ability of the organic photoreceptor is obtained so that sufficient image quality is obtained.

Photosensitive Layer

The layer constitution of the photoreceptor of the invention is preferably a separated function structure in which the function of the photosensitive layer is separated to a charge generation layer (CGL) and a charge transfer layer (CTL) though a single layer configuration may be applied, in which the charge generation function and the charge transfer function are possessed by one layer. By the function separating structure, the residual potential caused by repeatedly use can be controlled to low and another photographic property can be easily controlled so as to suit for purpose of use. In the negatively charging photoreceptor, a configuration is preferable, in which the charge generation layer is provided on the intermediate layer and the charge transfer layer is provided on the charge generation layer.

The constitution of the photoreceptor of the function separated negatively charging photoreceptor is described bellow.

Charge Generation Layer

The charge generation material represented by the formula (1) is incorporated in the charge generation layer of the organic photoreceptor. Another charge generation material may be used according to necessity additionally to the above charge generation material. A phthalocyanine pigment, an azo pigment, a perylene pigment and a polycyclic quinine pigment are cited as the pigment to be used together with.

Reins can be used as the binder of the charge generation material in the charge generation layer. A formal resin, a butyral resin, a silicone resin, a silicone-modified butyral resin and a phenoxy resin can be cited as a preferable resin. The ratio of the charge generation material to the resin binder is preferably 20 to 600 parts by weight per 100 parts by weight of the binder resin, and more preferably 300 to 600 parts by weight per 100 parts by weight of the binder resin. The pigment particles according to this invention can be incorporated much more amount for the amount of the binder than conventional pigment particles. The increasing in the residual potential caused by repeating use can be restrained by the use of such the resins. The thickness of the charge generation layer is preferably 0.3 μm to 2 μm.

Charge Transport Layer

The charge transfer layer may be constituted by a single layer or plural layers.

A charge transport layer is composed of a charge transport material and a binder to bind the charge transport material to form the layer. There may optionally be incorporated additives such as an antioxidant.

A positive hole type (P-type) charge transport material can be used as a charge transfer material (CTM), example of which includes a triphenylamine derivative, a hydrazone compound, styryl compound, benzidine compound and butadiene compound. It is preferable to use an organic compound exhibiting low absorbance for a laser light with an emission wavelength in the range of 400 to 500 nm, for example, compound (3) described below.

formula (3)

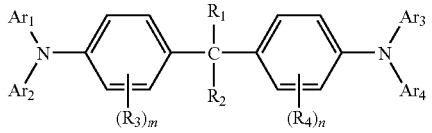

In the formula (3) $R_1$ and $R_2$ are each independently an alkyl group or an aryl group, provided that $R_1$ and $R_2$ may combine with each other to form a ring; $R_3$ and $R_4$ are each independently a hydrogen atom, an alkyl group or an aryl group; $Ar_1$ to $Ar_4$ are each a substituted or unsubstituted aryl group, $Ar_1$ to $Ar_4$ may be the same or different, and $Ar_1$ may form a ring structure by bonding to $Ar_2$, and $Ar_3$ may form a ring structure by bonding to $Ar_4$; m and n are each an integer of 1 to 4.

Specific examples of the compound represented by the foregoing formula (3) are shown below.

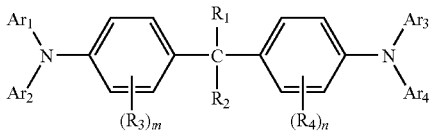

| CTM-No. | $Ar_1$ | $Ar_3$ | $Ar_2$ | $Ar_4$ |
|---|---|---|---|---|
| CTM-1 | $H_3C$ | $H_3C$ | $H_3C$ | $H_3C$ |
| CTM-2 | $H_3C$ | $H_3C$ | $H_3C$ | $H_3C$ |
| CTM-3 | $CH_3$ | $CH_3$ | $H_3C$ | $H_3C$ |
| CTM-4 | $CH_3$, $H_3C$ | $CH_3$, $H_3C$ | $H_3C$, $CH_3$ | $H_3C$, $CH_3$ |
| CTM-5 | $H_3C$ | $H_3C$ | $H_3C$ | $H_3C$ |
| CTM-6 | $H_3C$ | $H_3C$ | $H_3C$ | $H_3C$ |
| CTM-7 | $H_3C$, $H_3C$ | $H_3C$, $H_3C$ | $H_3C$ | $H_3C$ |
| CTM-8 | $H_3C$ | $H_3C$ | $H_3C$ | $H_3C$ |

-continued
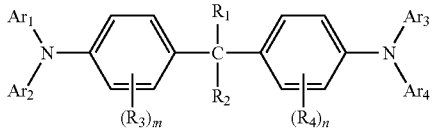
| | | | | |
|---|---|---|---|---|
| CTM-9 | 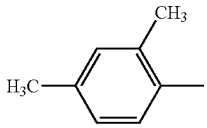 | 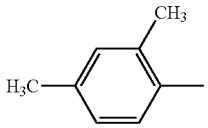 | 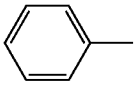 | 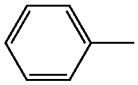 |
| CTM-10 | 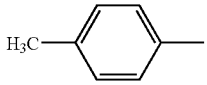 | 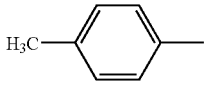 | 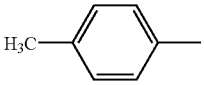 | 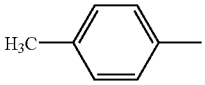 |
| CTM-11 | 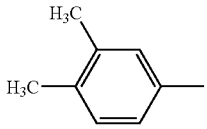 | 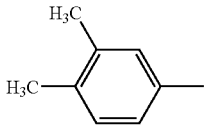 | 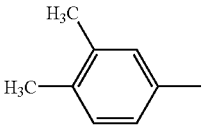 | 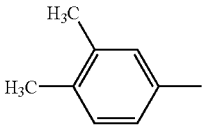 |
| CTM-12 | 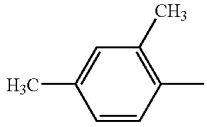 | 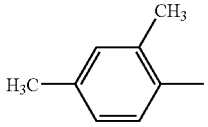 | 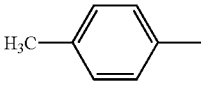 | 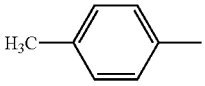 |
| CTM-13 | 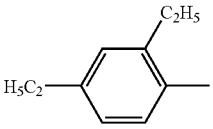 | 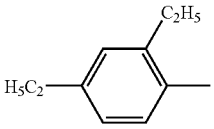 | 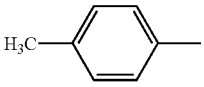 | 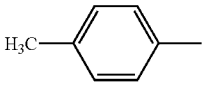 |
| CTM-14 | 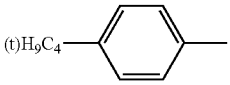 | 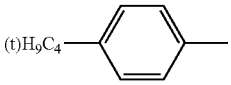 | 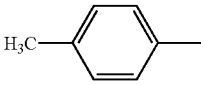 | 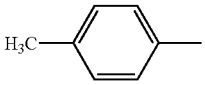 |
| CTM-15 | 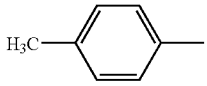 | 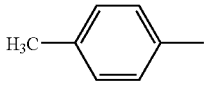 | 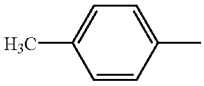 | 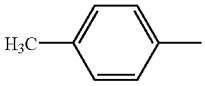 |
| CTM-No. | $R_1$ | $R_2$ | 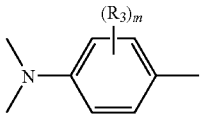 | 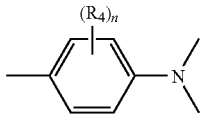 |
|---|---|---|---|---|
| CTM-1 | —$CH_3$ | —$CH_3$ | 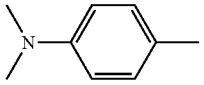 | 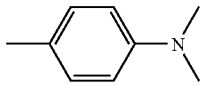 |
| CTM-2 | —$CH_3$ | —$C_2H_5$ | 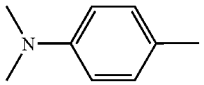 | 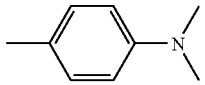 |
| CTM-3 | —$CH_3$ | —$C_3H_7$(i) | 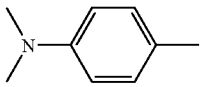 | 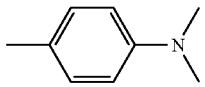 |
| CTM-4 | —$CH_3$ | —$C_4H_9$(n) | 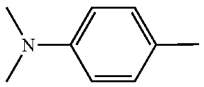 | 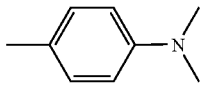 |

-continued
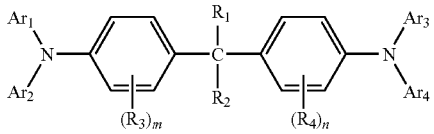
| | | | | |
|---|---|---|---|---|
| CTM-5 | —$CH_3$ | 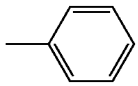 | 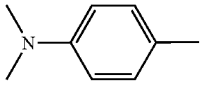 | 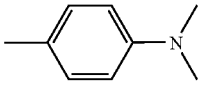 |
| CTM-6 | | 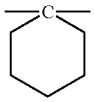 | 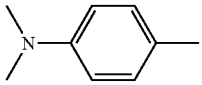 | 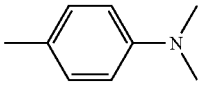 |
| CTM-7 | —$CH_3$ | —$CH_3$ | 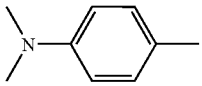 | 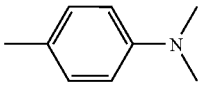 |
| CTM-8 | —H | —H | 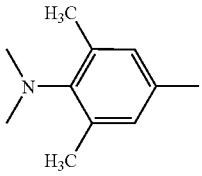 | 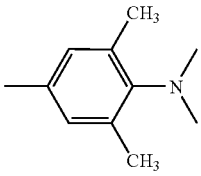 |
| CTM-9 | —$CH_3$ | —$CH_3$ | 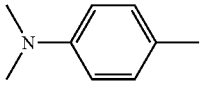 | 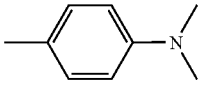 |
| CTM-10 | | 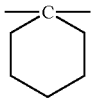 | 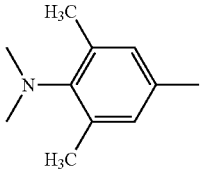 | 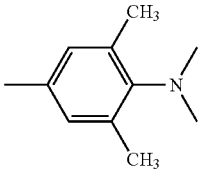 |
| CTM-11 | | 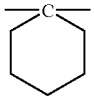 | 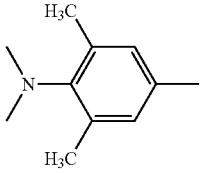 | 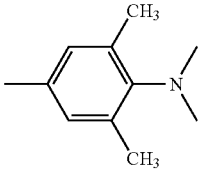 |
| CTM-12 | | 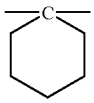 | 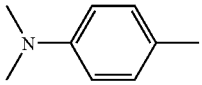 | 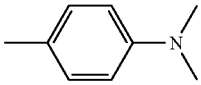 |
| CTM-13 | | 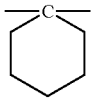 | 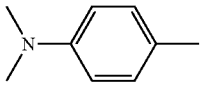 | 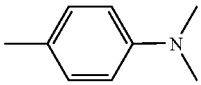 |
| CTM-14 | | 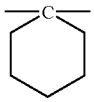 | 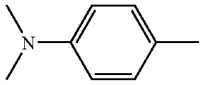 | 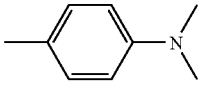 |
| CTM-15 | —$C_2H_5$ | —$C_2H_5$ | 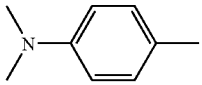 | 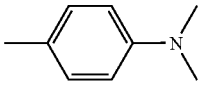 |

Synthesis Example 4

CTM-6

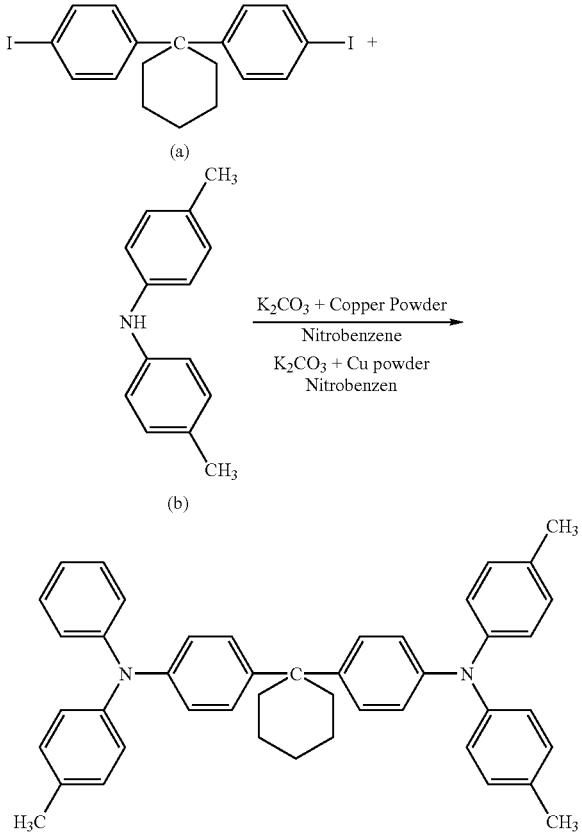

CTM-6

First, a 200 ml four-necked flask is provided with a cooler, a thermometer and a nitrogen introducing tube and a magnetic stirrer is set thereto. The interior of the flask is evacuated and completely replaced by nitrogen. Into the flask 8.1 g of the compound (a), 12.0 g of the compound (b) described above, 16 g of $K_2CO_3$ 8.0 g of copper powder and 40 ml of nitrobenzene were successively added. This mixture was reacted at 190° C. for 30 hr. Thereafter, reaction liquid was treated by vapor distillation, then was subjected to separation and purification by column chromatography employing hexane/toluene (4/1) as a developing solvent, to obtain 12 g of targeted compound CTM-6. The compound was identified by mass spectrometry and NMR.

The charge transfer material is usually dissolved in a suitable binder resin so as to form a layer. The binder resin usable in the charge transport layer may be any one of thermoplastic resins and thermo-setting resins. Specific examples of the binder resin include resins such as a polystyrene resin, polyacrylic resin, polymethacrylic resin, polyvinyl chloride resin, polyvinyl acetate resin, polyvinyl butyral resin, epoxy resin, polyurethane resin, phenol resin, polyester resin, alkyd resin, polycarbonate resin, silicone resin, and melamine resin, and a copolymer resin having at least two of repeating unit structures constituting the resins described above. Insulation Further, in addition to these resins are also cited polymer organic semiconductors, such as polyvinyl carbazole. Of these resins described above is specifically preferred a polycarbonate resin which exhibits low water absorption, capable of performing uniform dispersion of a charge transport material and also exhibits favorable electrophotographic characteristics.

The ratio of charge transport material to binder resin is preferably 50 to 200 parts by mass to 100 parts by mass of a binder resin.

The total thickness of a charge transport layer is preferably 10 to 30 μm. A latent image potential can be easily obtained and an image density and dot reproduction characteristics are improved when the thickness being 10 to 30 μm. The surface charge transfer layer is preferably 1.0 to 8.0 μm when the charge transfer layer is composed of a plurality layers.

Solvents and dispersing media used for an intermediate layer, a light-sensitive layer or a charge transport layer include, for example, n-butylamine, diethylamine, ethylenediamine, isopropanolamine, triethanolamine, triethylene diamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethylsulfoxide and methyl cellosolve. Tetrahydrofuran and methyl ethyl ketone involving little impact to human body or environment are preferred. These solvents may be used singly or in combination as mixed solvents.

Usable coating methods for production of electrophotographic photoreceptors include, for example, immersion coating, spray coating in addition to a slide hopper type coating.

A coating method employing slide hopper type coating apparatus among the coating composition supplying apparatus is most adequate when the coating composition is a dispersion employing the above mentioned low boiling point solvent. It is preferred to coat by using a circular amount control type slide hopper coating apparatus, for example, JP-A 58-189061.

It is preferable to incorporate an anti-oxidant in the surface layer of the photoreceptor of this invention. The surface layer is liable to be oxidized by an active gas such as NOx and ozone at charging to the photoreceptor, whereby an image blur is liable to generate.

In the following, there will be described an image forming apparatus in which the electrophotographic photoreceptor can be employed.

FIG. 1 shows an example of configuration of the image-forming apparatus. The image-forming apparatus includes charging device 2, image-writing device 3, developing device 4, transferring device 5 and cleaning device 6 disposed around photoreceptor 1, being a rotating drum-type member. Document reader 7 and automatic document feeder 8 are disposed on the upper side of the image-forming apparatus. Document sheets put on automatic document feeder 8 are conveyed one by one to document reader 7. In the document reader 7, light emitted from a light source mounted on first mirror unit 7*a* is irradiated onto the document sheet conveyed by automatic document feeder 8, so that the reflected light is focused onto CCD 7*d* through first mirror unit 7*a*, second mirror unit 7*b* and lens unit 7*c*. CCD 7*d* converts the focused image to electronic signals to store the electronic signals in a storage device, not shown in the drawings, equipped in the image-forming apparatus.

When images stored in the storage device reach to a predetermined amount, charging device 2 applies a uniform charging operation onto the surface of the photoreceptor 1.

Then, image-writing device 3 conducts an exposure scanning operation based on the image signals stored in the storage device to form an electrostatic latent image, and further, developing device 4 develops the electrostatic latent image with toner to form a toner image on the surface of photoreceptor 1.

Transfer sheet S is fed from paper feeding cassette 9*a*, 9*b* disposed at a sublevel of the image-forming apparatus, paper feeding mass-cassette 9*c* disposed at the lower level, manual paper-feeding cassette 9*d* disposed at the side surface, etc., and is conveyed to a transferring position through resist roller 10. Transferring device 5 transfers the toner image formed on the surface of photoreceptor 1 to transfer sheet S at the transferring position. Successively, fixing unit 11 applies heat and pressure onto transfer sheet S to fix the toner image on it. Then, paper ejecting roller 12*a* ejects transfer sheet S.

When forming images on both sides of the transfer sheet S, the conveying-path of transfer sheet S branches off the normal ejecting path to inversion-conveying path 12*c* by means of conveying-path switching plate 12*b* after the fixing operation with heat and pressure is applied to one side of the transfer sheet in fixing unit 11, so as to inverse the surface of the transfer sheet S by performing switchback action in the inversion-conveying path 12*c*. Then, the transfer sheet S again passes through transferring device 5 to form a toner image on reverse side of the transfer sheet S, and then, is ejected to outside of the apparatus by means of paper ejecting roller 12*a* after the fixing operation with heat and/or pressure is applied to the reverse side of the transfer sheet S in fixing unit 11. On the other hand, the surface of photoreceptor 1 after the image-forming operation is prepared for the next image-forming operation by removing residual developer remaining on the surface of the photoreceptor 1.

Image-writing device 3 is provided with LED-array head 31 including a LED array, in which a plurality of LED elements are arranged in a line, and a lens array, in which a plurality of lenses are arranged in a line. Since each of the LED elements composed of the LED array corresponds to each of the lenses included in the lens array one by one, it is possible to form the electrostatic latent image on the surface of the photoreceptor 1 by focusing the lights emitted from the LED elements onto the surface through the lenses. Further, a driving electronic current and/or a light emitting duration of each of the LED elements are/is compensated for in advance, so that an equality of the light intensity between the LED elements can be maintained.

A semiconductor laser or an emission diode at an emission wavelength of 350 to 500 nm is used as an exposure light source to form a latent image on the photoreceptor 21. Exposure is performed preferably at 10 to 50 μm of a dot diameter of exposure light from a light source. Exposure using fine-dots high resolution image formation of not less than 600 dpi to 2,500 dpi (dpi: number of dots per inch or 2.54 cm) is feasible on the photoreceptor 21 in the image forming apparatus of this invention.

"Exposure dot diameter" refers to the length of an exposure beam along the main-scanning direction (Ld: measured at maximum length) and falling within the region where the intensity of the exposure beam is $1/e^2$ or more of the peak intensity.

Light beams usable in the invention include a scanning optical system using a semiconductor laser and a solid scanner such as LED. The light intensity distribution includes, for example, a Gauss distribution and a Lorenz distribution. The exposure dot diameter is an area up to $1/e^2$ is a spot area in both of light intensity distributions in this invention.

A latent image formed on the photoreceptor 1 is developed by supplying a toner with the developing device 4 to form a visible toner image on the surface of the photoreceptor. It is preferred to use a polymer toner for a developer supplied by the developing device in this invention. Specifically, a combined use of the polymer toner having uniform shape or particle size distribution and the organic photoreceptor of this invention can achieve high-precise image formation of superior sharpness.

The latent image formed on the photoreceptor is visualized via development. The toner used in the development includes pulverized toner and granular polymerization toner. A granular polymerization toner is preferable in view of uniform particle distribution obtained by polymerization process.

Toner particles of the granular polymerization toner is prepared by a process wherein resin particles are prepared by polymerization and, if required, the resin particles are subjected to chemical process to obtain polymer particles having necessary particle diameter. Colorant is incorporated during the process.

The granular polymerization toner is practically prepared through polymerization such as suspension polymerization or emulsion polymerization, and fusing process of particles mutually conducted if required after the polymerization.

Volume average particle diameter of the toner, i.e., 50% volume particle diameter (Dv 50) is preferably 2-9 μm, and more preferably 3-7 μm in view of high image definition. Content of fine particles of the toner can be reduced despite of microparticle toner, and good image reproduction, good sharpness and stable image can be obtained for long period.

A developer used in the development stage may be a single component developer or a two-component developer.

Single component developers include a non-magnetic single component developer and a magnetic single component developer in which magnetic particles of 0.1 to 0.5 μm are contained in toner particles.

A two-component developer is prepared by mixing a toner with a carrier. Magnetic particles as a carrier can use conventionally used materials, for example, metals such as iron, ferrite and magnetite and alloys of the foregoing metals and a metal such as aluminum or zinc. Of these, ferrite particles are preferred. The foregoing magnetic particles preferably have a volume average particle size of from 15 to 100 μm, and more preferably from 25 to 80 μm.

The volume average particle size of a carrier can be determined typically using a laser diffraction type particle size distribution measurement apparatus, provided with a wet dispersing machine, HELOS (produced by SYMPATEC Corp.).

A carrier preferably is one in which a magnetic particle is covered with a resin and one in which magnetic particles are dispersed in a resin, so-called a resin dispersion type carrier. The examples of resin usable for the carrier coating include an olefin resin, styrene resin, styrene-acryl resin, silicone resin, ester resin and a fluoro-resin. Examples of a resin constituting a resin dispersion type carrier include a styrene-acryl resin, polyester resin, fluororesin and phenol resin.

The image forming apparatus may employ a system in which constituent elements such as the photoreceptor, the developing device, the cleaner and the like are integrated to form a so-called process cartridge of a unit structure which is easily detachable from the main body of the apparatus. In addition to unitization of plural constituent elements such a process cartridge as described above, at least one of a charger, an imagewise exposure device, a developing device, a transfer or separation device and a cleaner may be integrated with the photoreceptor 21 to form a cartridge unit which is easily detachable from the apparatus body.

Figure 2:
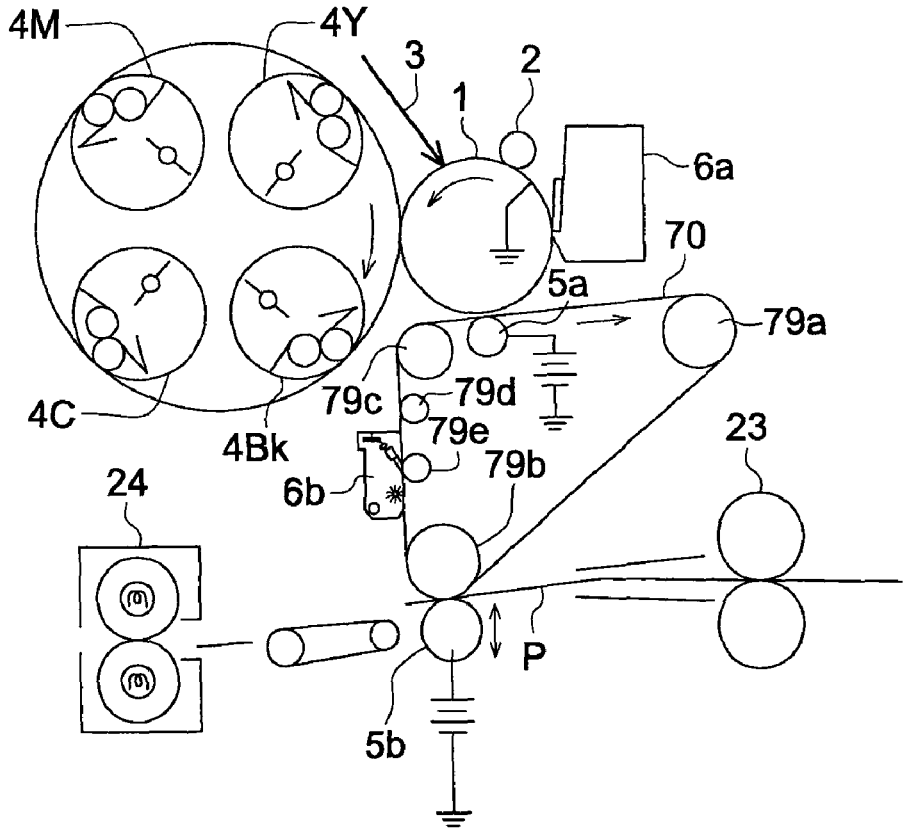
FIG. 2 is a cross-sectional configuration diagram of a color image forming apparatus fitted with an organic photoreceptor of the present invention.

FIG. 2 illustrates a sectional view of a color image forming apparatus using an organic photoreceptor according to this invention (a copier or a laser beam printer which comprises, around the organic photoreceptor, an electrostatic-charging means, an exposure means, plural developing means, a transfer means, a cleaning means and an intermediate transfer means). The intermediate transfer material 70 of an endless belt form employs an elastomer of moderate resistance.

The numeral 1 designates a rotary drum type photoreceptor, which is repeatedly used as an image forming body, is rotatably driven anticlockwise, as indicated by the arrow, at a predetermined circumferential speed.

The photoreceptor 1 is uniformly subjected to an electrostatic-charging process at a prescribed polarity and potential by a charging means 2 (charging step), while being rotated. Subsequently, the photoreceptor 1 is subjected to imagewise exposure via an imagewise exposure means 3 (imagewise exposure step) by using scanning exposure light of a laser beam modulated in correspondence to the time-series electric digital image signals of image data to form an electrostatic latent image corresponding to a yellow (Y) component image (color data) of the objective color image.

Subsequently, the electrostatic latent image is developed by a yellow toner of a first color in a yellow (Y) developing means 4Y: developing step (the yellow developing device). At that time, the individual developing devices of the second to fourth developing means 4M, 4C and 4Bk (magenta developing device, cyan developing device, black developing device) are in operation-off and do not act onto the photoreceptor 1 and the yellow toner image of the first color is not affected by the second to fourth developing devices.

The intermediate transfer material 70 is circulately driven clockwise at the same circumferential speed as the photoreceptor 1, while being tightly tensioned onto rollers 79*a*, 79*b*, 79*c*, 79*d* and 79*e*.

The yellow toner image formed and borne on the photoreceptor 1 is successively transferred (primary-transferred) onto the outer circumferential surface of the intermediate transfer material 70 by an electric field formed by a primary transfer bias applied from a primary transfer roller 5*a* to the intermediate transfer material 70 in the course of being passed through the nip between the photoreceptor 1 and the intermediate transfer material 70.

The surface of the photoreceptor 1 which has completed transfer of the yellow toner image of the first color is cleaned by a cleaning device 6*a*.

In the following, a magenta toner image of the second color, a cyan toner image of the third color and a black toner image of the fourth color are successively transferred onto the intermediate transfer material 70 and superimposed to form superimposed color toner images corresponding to the intended color image.

A secondary transfer roller 5*b*, which is allowed to bear parallel to a secondary transfer opposed roller 79*b*, is disposed below the lower surface of the intermediate transfer material 70, while being kept in the state of being separable.

The primary transfer bias for transfer of the first to fourth successive color toner images from the photoreceptor 1 onto the intermediate transfer material 70 is at the reverse polarity of the toner and applied from a bias power source. The applied voltage is, for example, in the range of +100 V to +2 kV.

In the primary transfer step of the first through third toner images from the photoreceptor 1 to the intermediate transfer material 70, the secondary transfer roller 5*b* and the cleaning means 6*b* for the intermediate transfer material are each separable from the intermediate transfer material 70.

The superimposed color toner image which was transferred onto the intermediate transfer material 70 is transferred to a transfer material P as the second image bearing body in the following manner. Concurrently when the secondary transfer roller 5*b* is brought into contact with the belt of the intermediate transfer material 70, the transfer material P is fed at a prescribed timing from paired paper-feeding resist rollers 23, through a transfer paper guide, to the nip in contact with the belt of the intermediate transfer material 70 and the secondary transfer roller 5*b*. A secondary transfer bias is applied to the second transfer roller 5*b* from a bias power source. By this secondary transfer bias the superimposed color toner image from the intermediate transfer material 70 is transferred to the transfer material P as a secondary transfer material (secondary-transfer). The transfer material P having the transferred toner image is introduced to a fixing means 24 and is subjected to thermal fixing.

The image forming method of the invention is suitable for electrophotographic instruments such as an electrophotographic copier, a laser printer, a LED printer and a liquid crystal shutter type printer and is also broadly applicable to instruments employing electrophotographic techniques for displaying, recording, light-printing, print plate making and facsimiles.

EXAMPLE

The present invention will further be detailed in terms of example. The terms parts and % in the EXAMPLE are parts by weight and % by weight, respectively, unless otherwise specified.

Dispersing was conducted in a circulation system while giving shear with rotating disk, beads and so forth employing a beads mill (Ultra Apex Mill equipped with a cooling water circulation system, manufactured by Kotobuki Industries Co., Ltd.) as a disperser.

<Dispersion Condition A>

The First Step of Dispersion

Composition formed from the following materials was dispersed under the following condition.

Pigment (CGM of synthetic example or the like)
6 parts by volume

Solvent {2-butanone/cyclohexane=4/1 (volume ratio)}
44 parts by volume

Dispersing was conducted under the following dispersion condition.

Dispersion Specification

Beads; ZrO beads each having a diameter of 0.3 mm, a filling ratio of 80%.

Disk peripheral speed: 3 m/sec.

Liquid temperature: 10-15° C.

Net dispersing time: 180 minutes (net dispersing time with a circulation type disperser).

The Second Step of Dispersion

A resin solution containing the following compounds were filtered by a membrane-filter (HDCII with a 100% rated filtration accuracy of 2.5 μm, manufactured by Pall Corporation), then the solution was added to the dispersion of the first step of dispersion after filtration.

Polyvinylbutyral resin (S-LEC BL-S, produced by Sekisui Chemical Co., Ltd.) 1 part by volume Solvent (2-butanone/cyclohexane=4/1 in volume ratio)
19 parts by volume The second dispersion was conduct under the following condition.

Dispersion Specification

Beads; ZrO beads each having a diameter of 0.3 mm, a filling ratio of 80%.

Disk peripheral speed: 3 m/sec.

Liquid temperature: 10-15° C.

Net dispersing time: 30 minutes.

The Third Step of Dispersion

The dispersion obtained by the second step of dispersion was once removed to replace beads, and dispersing was subsequently conducted under the following condition.

Dispersion Specification

Beads: ZrO beads each having a diameter of 0.03 mm, a filling ratio of 80%.

Disk peripheral speed: 5 m/sec.

Liquid temperature: 10-15° C.

Net dispersing time: 30 minutes.

Preparation of Dispersion Sample

Beads were removed after third step dispersion process to obtain Dispersion sample.

The combination concerning the above-described first step to third step of dispersion is designated as dispersion condition A.

<Dispersion Condition B>

The same dispersion condition as dispersion condition A, except that real dispersion time for the first step dispersion is replaced by 150 minutes, is designated as dispersion condition B.

<Dispersion Condition C>

The same dispersion condition as dispersion condition A, except that real dispersion time for the first step dispersion is replaced by 120 minutes, and real dispersion time for the third step dispersion is replaced by 60 minutes is designated as dispersion condition C.

<Dispersion Condition D>

The same dispersion condition as dispersion condition A, except that dispersion time for the second step dispersion is replaced by 15 minutes, is designated as dispersion condition D.

<Dispersion Condition E>

The same dispersion condition as dispersion condition A, except that real dispersion time for the second step dispersion is replaced by 60 minutes, is designated as dispersion condition E.

<Dispersion condition F>

The same dispersion condition as dispersion condition A, except that dispersion time for the third step dispersion is replaced by 15 minutes, is designated as dispersion condition F.

<Dispersion Condition G>

The same dispersion condition as dispersion condition A, except that real dispersion time for the first step dispersion is replaced by 60 minutes, is designated as dispersion condition G.

Preparation of Dispersion Samples 1 to 11

Dispersion Samples 1 to 11 were prepared by such a way that CGM of synthetic examples 1-3 and CGM-4 described below each was subjected to dispersing under any one of the above-described dispersion conditions A-G, as shown in the following Table 1. The resulting dispersion was coated on a glass substrate and dried; and samples for measuring an average major axis length, an average aspect ratio, an aspect ratio variation coefficient and so forth were prepared to measure these values by the foregoing measuring method. The results are shown in Table 1.

CGM-4

Dibromoanthanthrone pigment, shown below, obtained in the market was employed.

Into a glass tube made of PYREX (trade name) was placed 5.0 g of the dibromoanthanthrone. The glass tube was disposed in a furnace structured to provide a temperature gradient of ca. 440° C. to ca. 20° C. along the tube (capable of having a temperature gradient of ca. 440° C. to ca. 20° C. per 1 m). While the interior of the glass tube being evacuated to $1\times10^{-2}$ Pa, the position at which the glass tube containing a pyranthrone compound to be purified was disposed was heated to approximately 400° C. The thus formed vapor was moved to the lower temperature side to allow condensation. There was recovered 3.5 g of sublimated compound (CGM-4) condensed in the region of approximately 150-300° C.

TABLE 1

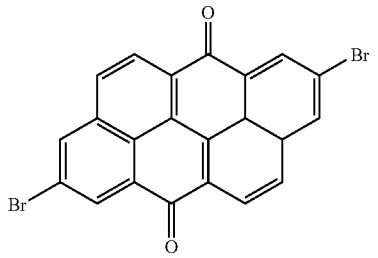

| Pigment particles Dispersion No. | Dispersion condition | Compound No. (CGM No.) | Average major axis length (nm) | Average aspect ratio | Aspect ratio variation coefficient |
|---|---|---|---|---|---|
| 1 | D | 1 | 350 | 2.0 | 14 |
| 2 | A | 1 | 350 | 2.5 | 12 |
| 3 | B | 1 | 400 | 3.5 | 16 |
| 4 | C | 1 | 450 | 5.0 | 8 |
| 5 | E | 1 | 400 | 6.0 | 14 |
| 6 | F | 1 | 400 | 3.5 | 17 |
| 7 | G | 1 | 550 | 3.5 | 15 |
| 8 | A | 2 | 200 | 4.0 | 10 |
| 9 | B | 2 | 300 | 5.0 | 15 |
| 10 | A | 3 | 450 | 3.0 | 9 |
| 11 | A | 4 | 420 | 4.0 | 15 |

Preparation of Photoreceptor

Photoreceptor 1 was prepared as described below.

The surface of a cylindrical aluminum substrate is subjected to cutting processing to prepare a conductive substrate having a 10 points surface roughness Rz of 0.12 μm.

<Intermediate Layer>

The following intermediate layer dispersion was diluted with the same mixture solvent by two times and filtrated by RIGIMESH filter having a nominal filtering accuracy of 5 μm, and a pressure of 50 kPa, manufactured by Nihon Pall Ltd., after standing for one night to prepare an intermediate layer coating solution.

(Preparation of Intermediate Layer Dispersion)

Binder resin: (Exemplified Polyamide N-1)

1 part (1.00 parts by volume)

N-type Semiconductor Particles:

Rutile type titanium oxide A1 {a primary particle diameter of 35 nm; one subjected to a surface treatment with an amount of 5% by weight in the total weight of titanium oxide employing a copolymer of methylhydrogen siloxane and dimethyl siloxane (a mole ratio of 1:1)}

3.5 parts (1.0 part by volume)

Ethanol/n-propyl Alcohol/THF (=45/20/30 in weight ratio) 10 parts

The above composition was mixed and dispersed with a butch system for 10 hours employing a beads mill disperser to prepare an intermediate layer dispersion.

The following intermediate layer coating composition was coated on the above-described electro-conductive substrate by an immersion coating method, and dried at 120° C. for 30 minutes to form an intermediate layer having a dry thickness of 1.0 μm.

<Charge Generation Layer>

The resulting dispersion 1 was used as a charge generation layer coating composition, and this coating composition was coated by an immersion coating method to form a charge generation layer having a dry thickness of 0.5 μm on the foregoing intermediate layer.

| <Charge transport layer (CTL)> | |
|---|---|
| Charge transport material (CTM): the foregoing CTM-1 | 225 parts |
| Polycarbonate (Z300, manufactured by Mitsubishi Gas Chemical Company, Inc.) | 300 parts |
| Antioxidant (a compound shown below) | 6 parts |
| THF/toluene mixed liquid (volume ratio: 3/1) | 2,000 parts |
| Silicone oil (KF-54, produced by Shin-Etsu Chemical Co., Ltd.) | 1 Part |

The above-described were mixed and dissolved to prepare a charge transport layer coating solution. This coating solution was coated on the foregoing charge generation layer by an immersion coating method, and dried at 110° C. for 70 minutes to form a charge transport layer having a dry thickness of 20.0 μm, whereby photoreceptor 1 was prepared.

AO-1

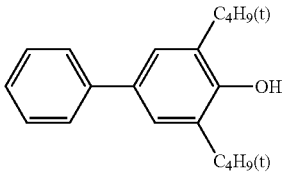

Preparation of Photoreceptors 2 to 12

Photoreceptors 2 to 11 were prepared similarly to preparation of photoreceptor 1, except that dispersion for a charge generation layer coating composition and substrates were changed from dispersion 1 to each of dispersions 2 to 11 as shown in Table 2.

Preparation of Samples for Measuring Quantum Efficiency

Samples for measuring quantum efficiency 1 to 12 were prepared by the same way as the Samples 1 to 12 described above, except that gold sputtering electrode having 2×2 cm. Quantum efficiency of each sample was measured by an above-described method. LED having emission peak wavelength of 405 nm was employed as the irradiation light. The other conditions are the same as described above.

Evaluation

A remodeled digital complex copier bizhub PRO 1050e, manufactured by Konica Minolta Business Technologies, Inc., was used for evaluation (an LED having an emission wavelength of 405 nm was used, and the composite printer was modified so as to irradiate at 1200 dpi with a dot diameter of 30 μm and processing speed of 480 mm/sec), and each of photoreceptors 1-12 was installed in the complex copier to conduct evaluation. The evaluation items and evaluation criteria are shown below.

Evaluation of Image Noise

Endurance test of the organic photoreceptor samples was conducted by printing A4 size paper at normal temperature and humidity (20° C. and 50% RH). The test was conducted in an intermittent mode which repeats a cycle of one sheet printing and stopping. Five sheets were printed at the initial stage and just after 10,000th printing, and evaluation was made by observing occurrence of black spots or fog was determined.

A number of black spots having major axis of not less than 0.4 mm on A4 size paper was observed.

It is acceptable in practical use The sample having not more than 3 black spots per A4 size paper is good for practical use, from 4 to 10 spots per is no problem in practical use, and not less than 11 black spots is not acceptable in practical use.

Gradation Evaluation

A gradation chart having 15 steps density from white to solid black was printed at the initial stage of endurance test to evaluate gradation characteristics. Significant steps were measured by human eyes observation in the condition of sufficient brightness under sun light. Significant steps of 11 or more is good for practical use, 7 to 10 is no problem in practical use, and 6 or less is not acceptable in practical use.

The results are summarized in Table 2.

TABLE 2

| Photo-receptor Sample | Rz of substrate | Dispersion Sample | Quantum Efficiency | Black spots | Gradation steps |
|---|---|---|---|---|---|
| 1 | 0.12 | 1 | 0.65 | 14 | 11 |
| 2 | 0.12 | 2 | 0.68 | 4 | 11 |
| 3 | 0.20 | 3 | 0.60 | 6 | 10 |
| 4 | 0.12 | 4 | 0.53 | 7 | 10 |
| 5 | 0.12 | 5 | 0.55 | 15 | 9 |
| 6 | 0.12 | 6 | 0.58 | 13 | 9 |
| 7 | 0.12 | 7 | 0.45 | 8 | 6 |
| 8 | 0.12 | 8 | 0.71 | 0 | 11 |
| 9 | 0.05 | 9 | 0.68 | 1 | 11 |
| 10 | 0.12 | 10 | 0.61 | 5 | 11 |
| 11 | 0.12 | 11 | 0.41 | 8 | 6 |
| 12 | 0.25 | 2 | 0.68 | 16 | 7 |

The photoreceptor samples 2-4 and 8-10 each satisfies the all requirements of (A) the substrate has a ten-point surface roughness Rz of the substrate of 0.2 μm or less, (B) the charge generation layer comprises particles of a condensed polycyclic pigment, having an average major axis length of 500 nm or less, an average aspect ratio of 2.5 to 5.0, and an aspect ratio variation coefficient of 16% or less, and (C) quantum efficiency Φ of the photoreceptor is not less than 0.5, show good result in both image noise and gradation evaluation. The photoreceptor samples which do not satisfy the requirement (B) are insufficient in image noise evaluation as shown in samples 1, 5 and 6, and gradation is not insufficient as shown in sample 7. The photoreceptor sample 11 which do not satisfy the requirement (C) is inferior in gradation evaluation. The photoreceptor sample which do not satisfy the requirement (A) is inferior in image noise evaluation evaluation.

What is claimed is:

1. An organic photoreceptor comprising a charge generation layer and a charge transport layer provided on a conductive substrate, wherein the substrate has a ten-point surface roughness Rz of the substrate of 0.2 μm or less, the charge generation layer comprises a charge generation material comprising particles of a condensed polycyclic pigment, having an average major axis length of 500 nm or less, an average aspect ratio of 2.5 to 5.0, and an aspect ratio variation coefficient of 16% or less, and quantum efficiency Φ of the photoreceptor is not less than 0.5, the quantum efficiency Φ being defined by a Formula of $\Phi=\Delta Q/(n_0\times e)$, wherein ΔQ is reduced amount of charge [C] in case that light having light amount predetermined so as to make the electric field E becomes ⅔ times of initial electric field after unit time (1 sec.) is exposed to the organic photoreceptor under condition of the initial electric field $E_0=2.5\times10^5$ [$V\cdot cm^{-1}$], and $n_0$ is a number of incident photons per unit area (1 $cm^2$) and in unit time (1 sec.) in terms of [$cm^{-2}\cdot s^{-1}$] in case that light having light amount predetermined so as to make the electric field E becomes ⅔ times of initial electric field after unit time (1 sec.) is exposed to the organic photoreceptor under condition of the initial electric field $E_0=2.5\times10^5$ [$V\cdot cm^{-1}$], and e is an elementary electric charge $1.3\times10^{-19}$ [C], wherein the condensed polycyclic pigment is represented by Formula (1):

Formula (1)

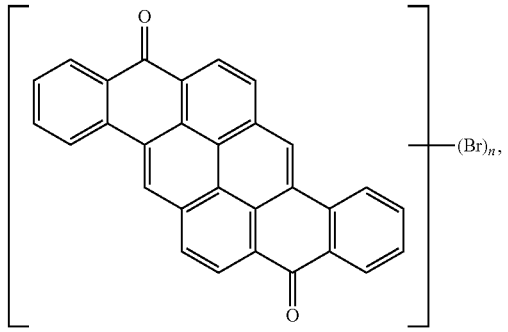

wherein n is an integer of 1-6.

2. The organic photoreceptor of claim 1, wherein the charge generation layer comprises the charge generation material and a binder resin, a content of the charge generation material is 20 to 600 parts by weight, with respect to 100 parts by weight of the binder resin.

3. The organic photoreceptor of claim 1, wherein the content of the charge generation material is 300 to 600 parts by weight, with respect to 100 parts by weight of the binder resin.

4. The organic photoreceptor of claim 1, comprising the charge generation layer formed by coating a dispersion comprising particles of the condensed polycyclic pigment, having an average major axis length of 500 nm or less, an average aspect ratio of 2.5 to 5.0, and an aspect ratio variation coefficient of 16% or less prepared via multi-step dispersion.

* * * * *